US006959751B2

(12) United States Patent
Savard et al.

(10) Patent No.: US 6,959,751 B2
(45) Date of Patent: Nov. 1, 2005

(54) WINDING SYSTEM, ROLLING DOOR ASSEMBLY INCLUDING THE SAME AND KIT FOR ASSEMBLING THE WINDING SYSTEM

(75) Inventors: Normand Savard, Drummondville (CA); Pierre-Louis Foucault, St-Lambert (CA); Philippe Larochelle, Drummondville (CA)

(73) Assignee: Canimex Inc., Quebec (CA)

( * ) Notice: Subject to any disclaimer, the term of this patent is extended or adjusted under 35 U.S.C. 154(b) by 101 days.

(21) Appl. No.: 10/420,987

(22) Filed: Apr. 22, 2003

(65) Prior Publication Data

US 2003/0230389 A1 Dec. 18, 2003

(30) Foreign Application Priority Data

Apr. 22, 2002 (CA) ..... 2382822
Jul. 4, 2002 (CA) ..... 2392417

(51) Int. Cl.[7] ..... A47G 5/02
(52) U.S. Cl. ..... 160/315; 160/191; 160/318; 242/375.1; 49/200
(58) Field of Search ..... 160/133, 201, 160/191, 192, 315, 318; 242/375.1; 49/200

(56) References Cited

U.S. PATENT DOCUMENTS 1,937,209 A * 11/1933 Trant ..... 160/23.1
3,979,977 A * 9/1976 Dorma ..... 81/57.13
5,964,268 A * 10/1999 Carper et al. ..... 160/191
6,125,582 A * 10/2000 Mondragon et al. ..... 49/200
6,263,942 B1 * 7/2001 Miller ..... 160/23.1

* cited by examiner

*Primary Examiner*—Blair M. Johnson
(74) *Attorney, Agent, or Firm*—Merchant & Gould P.C.

(57) ABSTRACT

A winding system for winding a rolling door assembly. The winding system includes a support bracket, first and second gears. The support bracket is preferably rigidly connectable to a fixed structure of the rolling door assembly, and has a receiving device and a supporting device. The first gear is pivotally mounted about the receiving device of the support bracket and rotatable thereabout along opposite first and second directions of rotation. The second gear is pivotally mounted about the supporting device of the support bracket and rotatable thereabout along opposite first and second directions of rotation. The first gear is operatively connected to a corresponding end of the counterbalancing spring of the rolling door assembly. The second gear is threadably engaged with the first gear such that, a rotation of the second gear along one of its first and second directions of rotation causes the first gear to rotate along a corresponding one of its first and second directions of rotation, thereby resulting in a corresponding winding of the counterbalancing spring of the rolling door assembly.

17 Claims, 9 Drawing Sheets

WINDING SYSTEM, ROLLING DOOR ASSEMBLY INCLUDING THE SAME AND KIT FOR ASSEMBLING THE WINDING SYSTEM

FIELD OF THE INVENTION

The present invention relates to a winding system. More particularly, the present invention relates to a winding system for winding a rolling door assembly, such as mini-warehouse doors, commercial rolling steel doors, and the like, for example. The present invention also relates to a rolling door assembly provided with such a winding system and to a kit for assembling the winding system.

BACKGROUND OF THE INVENTION

Rolling door assemblies, such as mini-warehouse doors, commercial rolling steel doors, and the like, are very well known in the art.

These rolling door assemblies typically comprise an overhead shaft which is mounted onto a fixed structure, such as a wall for example, a drum mounted about the overhead shaft, and a door curtain foldable (i.e. wound, coiled-up, etc.) about the drum and unfoldable from the same via a rotation of the drum so as to alternatively lower and raise the curtain, i.e. operate the door. Generally, these rolling door assemblies also generally comprise at least one, but typically a pair of, counterbalancing spring(s) having ends operatively connected to corresponding parts of the assembly for providing the same with a suitable counterbalancing force. This counterbalancing force is used namely to decrease force required to open the door and also facilitate its closing.

Also known in the art are two main types of rolling door assemblies, namely "dead shaft" rolling door assemblies and "live shaft" rolling door assemblies.

A "dead shaft" rolling door assembly is one in which, after proper installation thereof, the overhead shaft is securely fixed and tightened onto the fixed structure by means of brackets and corresponding fasteners, and thus does not rotate during normal operation of the rolling door assembly. In contrast, a "live shaft" rolling door assembly is one in which, after proper installation thereof, the overhead shaft is pivotally connected to the fixed structure and rotates thereabout during normal operation of the rolling door assembly.

In the case of a "dead shaft" rolling door assembly, the drum is pivotally mounted about the overhead shaft and rotates thereabout, and each counterbalancing spring typically has first and second ends operatively connected to the shaft and drum respectively so as to be wound and unwound accordingly, depending on the operation of the door assembly, so as to provide a corresponding counterbalancing force thereto.

In the case of a "live shaft" rolling door assembly, the drum is securely mounted about the overhead shaft and rotatable therewith with respect to the fixed structure, and each counterbalancing spring typically has first and second ends operatively connected to the shaft (or drum) and fixed structure respectively so as to be wound and unwound accordingly, depending on the operation of the door assembly, so as to provide a corresponding counterbalancing force thereto.

It is also known in the art that with "live shaft" rolling door assemblies for example, the winding thereof needs to be properly calibrated in order to ensure a suitable operation of the door assembly. Typically, an installer must use a winding system having a portion which cooperates with the fixed structure onto which a corresponding end of the counterbalancing spring of the assembly is operatively connected, said portion having corresponding sockets for receiving a winding bar. The aforementioned portion of the winding system is rotated by the installer with the winding bar inserted into a corresponding socket in order to provide the counterbalancing spring with a suitable torque, such that the latter may offer a corresponding suitable counterbalancing force. A problem associated with this type of winding is that it is carried out at elevated heights, typically using a ladder, given the fact that the overhead shafts of rolling door assemblies are generally located well above ground level or well out of human reach. Another problem associated with this type of winding is that is it difficult to achieve a precise winding because the winding of the assembly results from a rough estimate of the installer manually operating the winding bar, which is used as a lever arm for winding the assembly. Another problem associated with the above-mentioned type or winding is that a considerable effort is required from the installer to carry out the above-mentioned maneuvers, often causing him to force onto the parts and causing him also to undertake very precarious movements and/or positions, which is undesirable. Another problem associated with the above-mentioned conventional winding system is that it is not provided with a safety device which would prevent the rolling door assembly and/or the winding (or "counterbalancing") thereof from being inadvertently tampered with.

Hence, in light of the aforementioned, there is a need for an improved system and/or method for winding a rolling door assembly which would be able to overcome some of the aforementioned problems.

SUMMARY OF THE INVENTION

The object of the present invention is to provide a winding system which, by virtue of its design and components, satisfies some of the above-mentioned needs and is thus an improvement over other related winding systems and/or methods known in the prior art.

In accordance with the present invention, the above object is achieved with a winding system for winding a rolling door assembly having an overhead shaft mounted about a fixed structure and rotatable thereabout along opposite first and second directions of rotation, a drum mounted about said overhead shaft, a door curtain foldable about the drum and unfoldable from the drum via a rotation of the drum, and a counterbalancing spring having first and second ends operatively connected to the overhead shaft and the fixed structure respectively for counterbalancing the rolling door assembly, the winding system comprising:

a support bracket rigidly connectable to the fixed structure, said support bracket having receiving means and supporting means, the receiving means comprising a hub projecting from the support plate;

a first gear pivotally mounted about the hub of the receiving means of the support bracket and rotatable thereabout along opposite first and second directions of rotation, the first gear being operatively connectable to the second end of the counterbalancing spring, a portion of the overhead shaft being extendable through said first gear and said hub;

a second gear pivotally mounted about the supporting means of the support bracket and rotatable thereabout along opposite first and second directions of rotation, said second gear being threadably engaged with the first gear such that, rotation of said second gear along one of its first and second directions of rotation causes the first gear to rotate along a corresponding one of its first and second directions of rotation, thereby resulting in a corresponding winding of the counterbalancing spring of the rolling doer assembly; and at least one spacer projecting from the support bracket said at least one spacer being positioned proximate the hub for abutting the first gear and delimiting positioning of the first gear front the support bracket, the hub comprising at least one longitudinal strip being foldable against the first gear for maintaining the first gear secured against the at least one spacer.

According to another aspect of the present invention, there is also provided a rolling door assembly having an overhead shaft mounted about a fixed structure and rotatable thereabout along opposite first and second directions of rotation, a drum mounted about said overhead shaft, a door curtain foldable about the drum and unfoldable from the drum via a rotation of the drum, and a counterbalancing spring having first and second ends operatively connected to the overhead shaft and the fixed structure respectively for counterbalancing the rolling door assembly, the rolling door assembly being provided with a winding system comprising:

a support bracket rigidly connectable to the fixed structure, said support bracket having receiving means and supporting means, the receiving means comprising a hub projecting from the support plate;

a first gear pivotally mounted about the hub of the receiving means of the support bracket and rotatable thereabout along opposite first and second directions of rotation, the first gear being operatively connected to the second end of the counterbalancing spring, a portion of the overhead shaft being extendable through said first gear and said hub;

a second gear pivotally mounted about the supporting means of the support bracket and rotatable thereabout along opposite first and second directions of rotation, said second gear being threadably engaged with the first gear such that, a rotation of said second gear along one of its first and second directions of rotation causes the first gear to rotate along a corresponding one of its first and second directions of rotation, thereby resulting in a corresponding winding of the counterbalancing spring of the rolling door assembly; and at least one spacer projecting from the support bracket said at least one spacer being positioned proximate the hub for abutting the first gear and delimiting positioning of the first gear from the support bracket, the hub comprising at least one longitudinal strip being foldable against the first gear for maintaining the first gear secured against the at least one spacer.

According to yet another aspect of the present invention, there is also provided a kit for assembling a winding system for winding a rolling door assembly having an overhead shaft mounted about a fixed structure and rotatable thereabout along opposite first and second directions of rotation, a drum mounted about said overhead shaft, a door curtain foldable about the drum and unfoldable from the drum via a rotation of the drum, and a counterbalancing spring having first and second ends operatively connected to the overhead shaft and the fixed structure respectively for counterbalancing the rolling door assembly, the kit comprising:

a support bracket rigidly connectable to the fixed structure, said support bracket having receiving means and supporting means, the receiving means comprising a hub projecting from the support plate;

a first gear pivotally mountable about the hub of the receiving means of the support bracket and rotatable thereabout along opposite first and second directions of rotation, the first gear being operatively connectable to the second end of the counterbalancing spring, a portion of the overhead shaft being extendable through said first gear and said hub;

a second gear pivotally mountable about the supporting means of the support bracket and rotatable thereabout along opposite first and second directions of rotation, said second gear being operatively connected to the second end of the counterbalancing spring and being also threadably engaged with the first gear when the winding system is assembled such that, rotation of said first gear along one of its first and second directions of rotation causes the second gear to rotate along a corresponding one of its first and second directions of rotation, thereby resulting in a corresponding winding of the counterbalancing spring of the rolling door assembly; and at least one spacer projecting from the support bracket, said at least one spacer being positioned proximate the hub for abutting the first gear and delimiting positioning of the first gear front the support bracket, the hub comprising at least one longitudinal strip being foldable against the first gear for maintaining the first gear secured against the at least one spacer.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
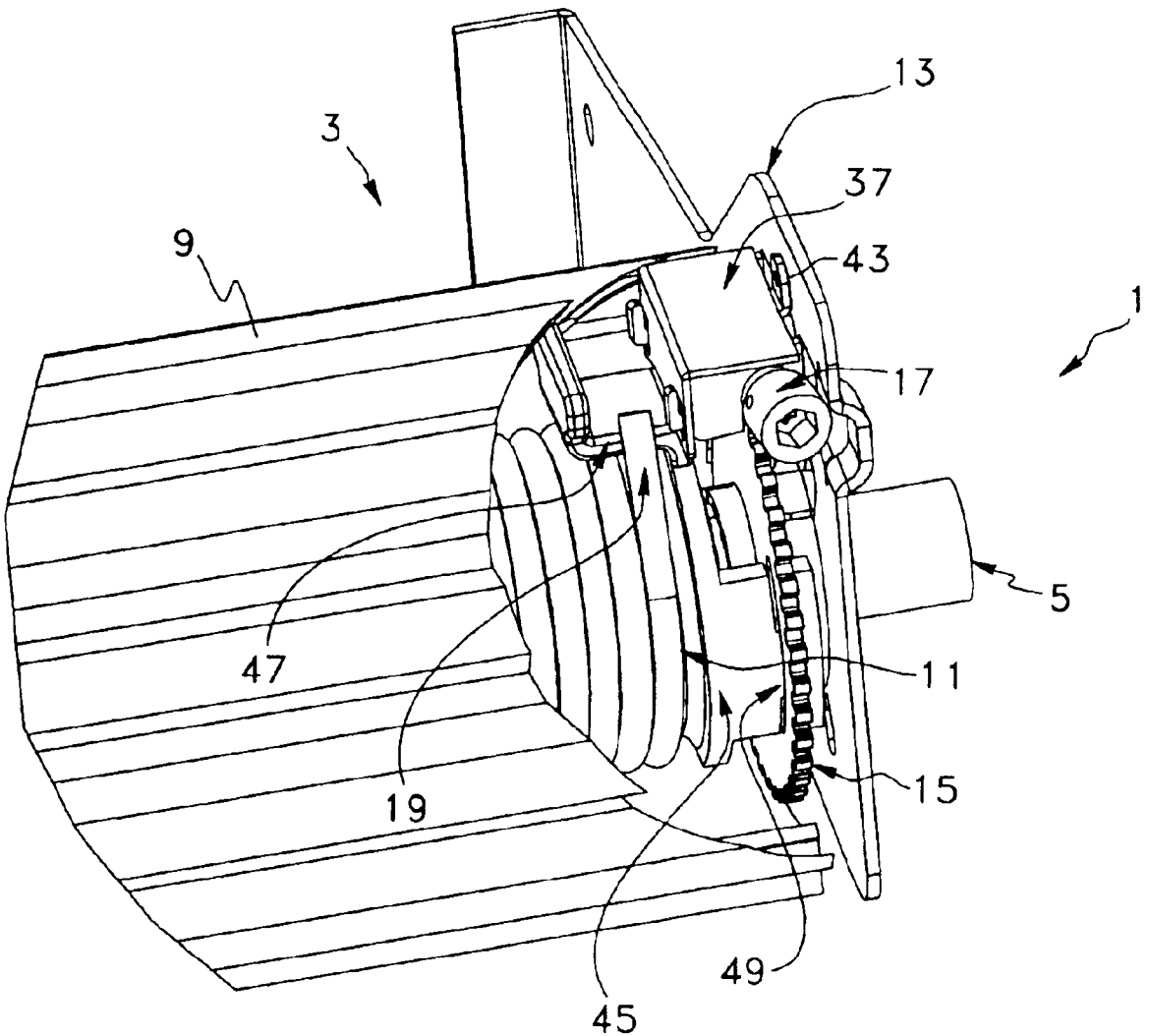
FIG. 1 is a fragmentary perspective view of a rolling door assembly provided with a winding system according to a first preferred embodiment of the invention.
Figure 2:
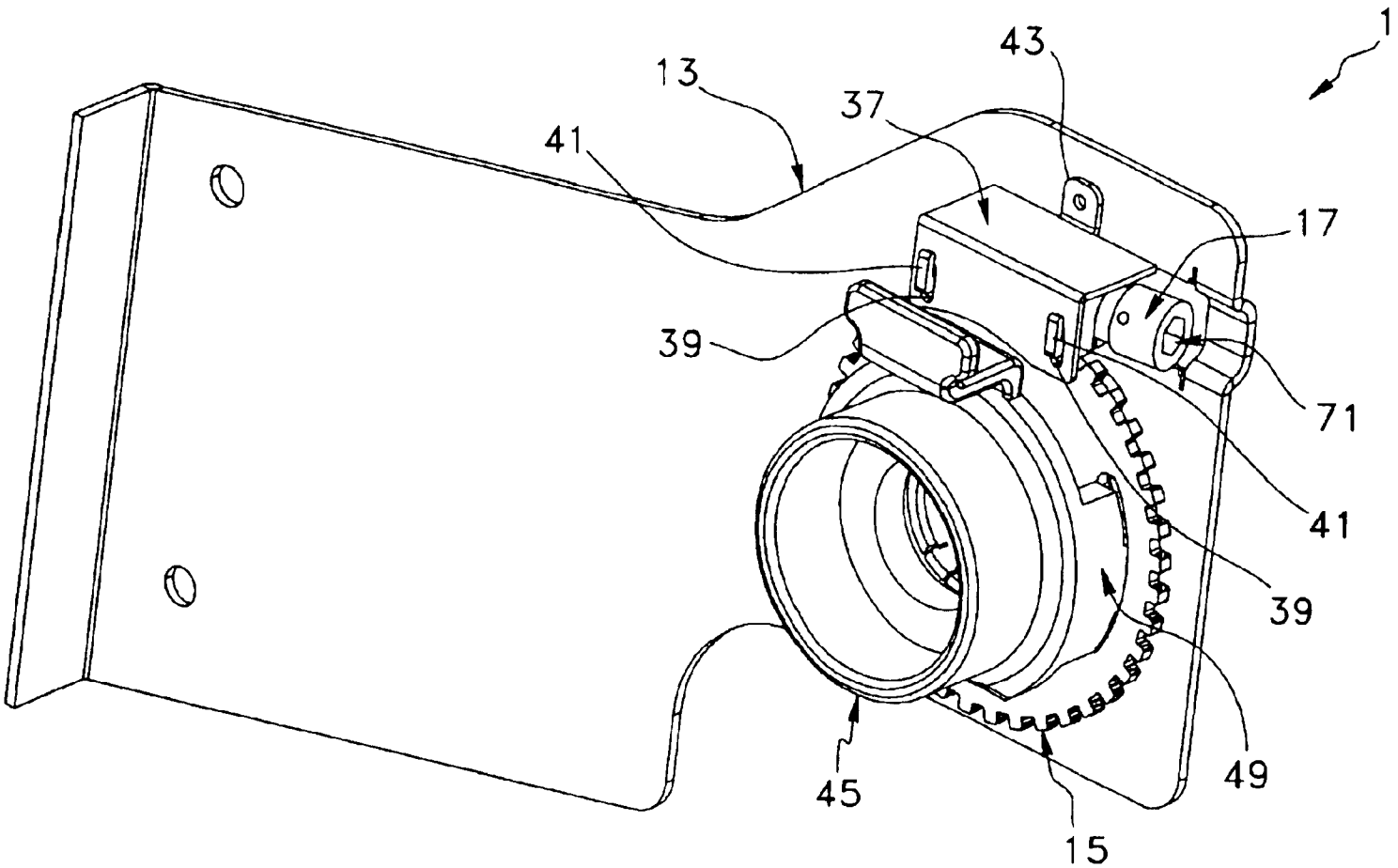
FIG. 2 is a perspective view of the winding system shown in FIG. 1.
Figure 3:
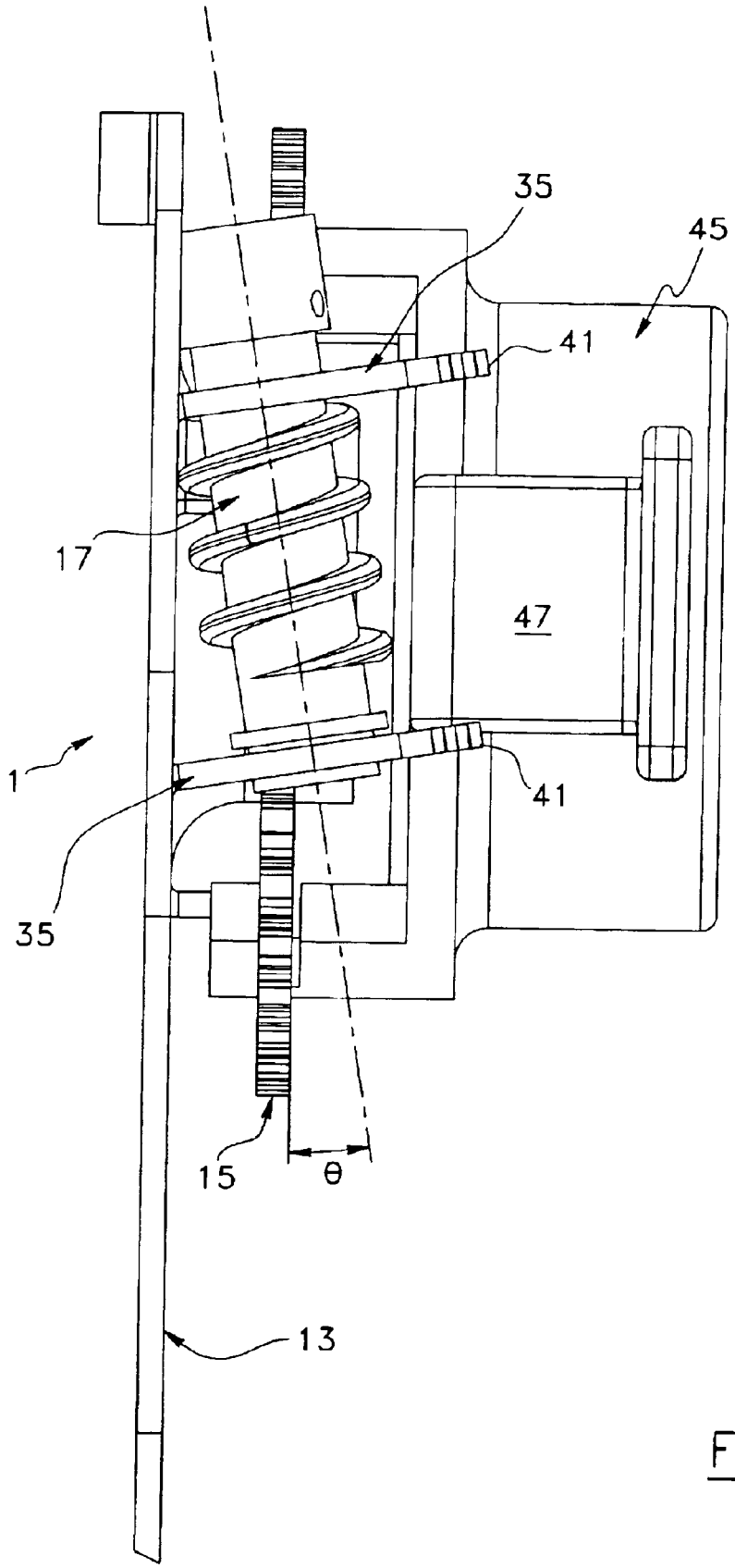
FIG. 3 is a top plan view of the winding system of FIG. 2, said winding system being shown without a cap.

In the following description, the same numerical references refer to similar elements. The embodiments shown in the figures are preferred.

In the context of the present description, the expression "rolling door assembly" includes various types of rolling door assemblies, such as mini-warehouse doors, commercial rolling steel doors, and the like. Although the present invention was primarily designed for a live shaft rolling door assembly, it may be used with other kinds of rolling door assemblies, such as fire doors or shutters, or with any other counterbalanced door assemblies using an overhead shaft, as apparent to a person skilled in the art. For this reason, the expression "live shaft" and/or "rolling door assembly" should not be taken as to limit the scope of the present invention and includes all other kinds of doors assemblies or items with which the present invention may be used and could be useful.

Moreover, in the context of the present description, the expressions "door" and "assembly", "curtain" and "door", "counterbalancing shaft" and "overhead shaft", "system" and "device", "winding" and "counterbalancing", as well as any other equivalent expressions and/or compound words thereof, may be used interchangeably. The same applies for any other mutually equivalent expressions, such as "plate" and "bracket" for example, as apparent to a person skilled in the art.

In addition, although the preferred embodiment of the present invention as illustrated in the accompanying drawings comprises various components such as a hub, a plug, spacer(s), strip(s), supporting arm(s), a cap, a flange, tongue (s), slit(s), a safety device, a tab, a spring, etc., and although the preferred embodiment of winding system 1 and corresponding parts of the present invention as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the winding system 1 according to the present invention, as will be briefly explained herein and as can be easily inferred herefrom, without departing from the scope of the invention.

Broadly described, the winding system 1 according to the present invention, as exemplified in the accompanying drawings, is a winding system 1 devised for winding a rolling door assembly 3, such as mini-warehouse doors, commercial rolling steel doors, and the like, but may also be used for other types of installations where a torque must be applied onto a counterbalanced system having an overhead shaft.

The winding system 1 according to the present invention is particularly useful for winding a rolling door assembly 3 having an overhead shaft 5 mounted about a fixed structure 7 and rotatable thereabout along opposite first and second directions, corresponding respectively to a raising and a lowering of the door 9. The rolling door assembly 3 generally further comprises a drum (not shown) mounted about the overhead shaft 5 and a door curtain 9 foldable about the drum and unfoldable from the same via rotation of the drum. The rolling door assembly 3 preferably also comprise a counterbalancing spring 11 operatively connected between corresponding parts of the assembly 3 for counterbalancing the same. In the case of a "live shaft" rolling door assembly 3 for example, the counterbalancing spring 11 is operatively connected between the overhead shaft 5 (or drum for example) and a fixed structure 7 of the assembly 3 for counterbalancing the rolling door assembly 3. It is worth mentioning that, instead of using a counterbalancing spring 11, the rolling door assembly 3 according to the present invention may be counterbalanced by other suitable means, such as counterweights for example, as apparent to a person skilled in the art.

According to the present invention, and as better shown in FIGS. 1-5, the winding system 1 comprises a support bracket 13, and first and second gears 15,17. Preferably, the first and second gears 15,17 are part of a worm gear assembly, although other suitable gear assemblies, such as a spur gear assembly, a bevel gear assembly, a rack-and-pinion gear assembly, a planetary gear assembly, and the like, for example, may be used according to the present invention, provided the first and second gears 15,17 are meshed with one another so that displacement (e.g. rotation) of one is transmitted to the other, and vice versa, the first gear 15 being operatively connected to an end 19 of the counterbalancing spring 11 of the assembly 3, and the second gear 17 being used for winding or "counterbalancing" the spring 11, and thus the assembly 3, via the first gear 15, as can be easily understood by a person skilled in the art.

Figure 6:
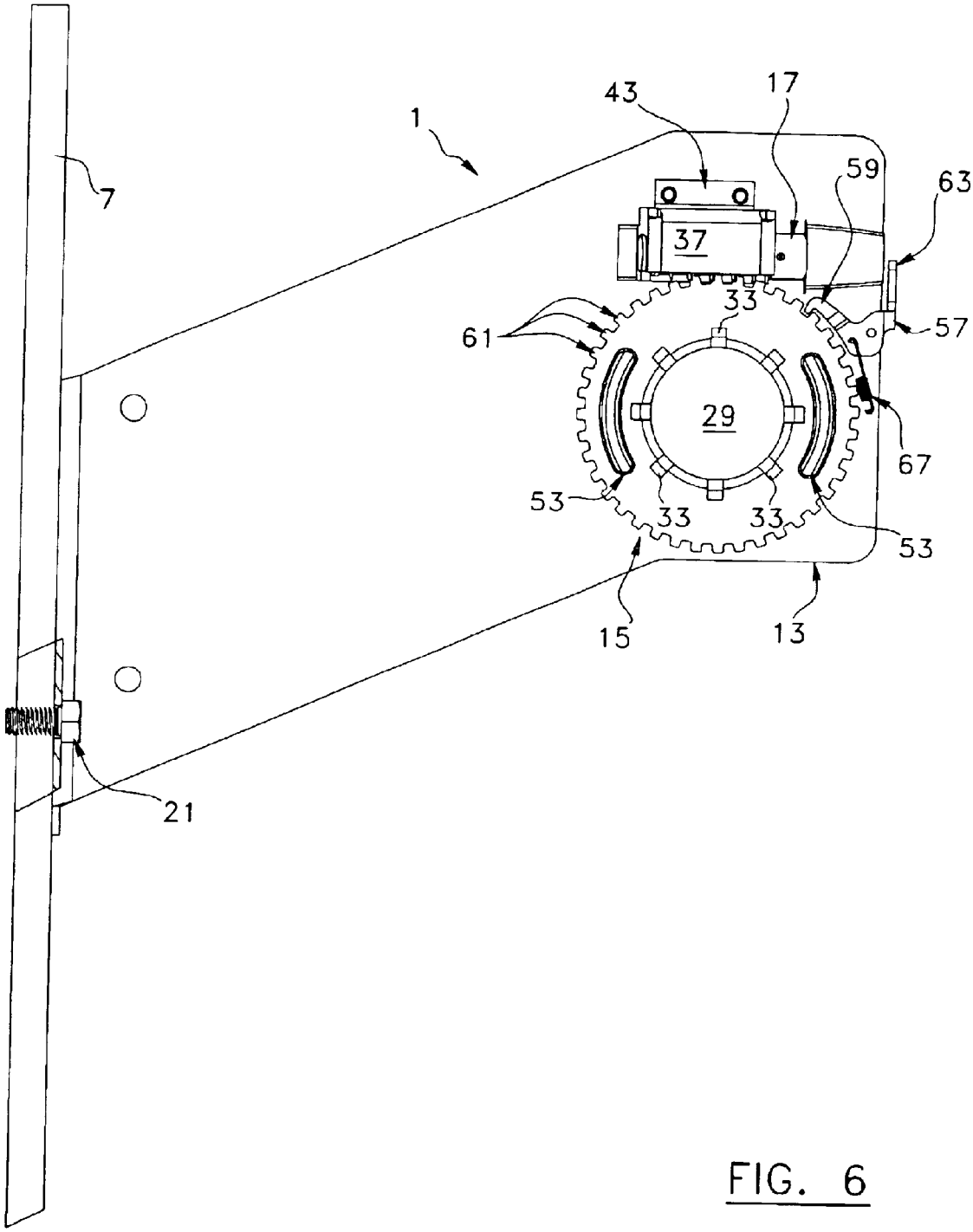
FIG. 6 is a side view of a winding system according to another preferred embodiment of the invention, said winding system being shown mounted onto a fixed structure and with its safety device in the first position.

Preferably, the support bracket 13 is rigidly connected to the fixed structure 7, such a wall for example, by means of suitable fasteners 21, as better shown in FIG. 6. The fasteners 21 may consist of a bolt combined with other suitable complementary pieces, such as a nut, a washer, a spacer, and/or the like, as exemplified in FIG. 6 and as apparent to a person skilled in the art. In such a case, the support bracket 13 of the winding system 1 preferably acts as a wall bracket 13 for the rolling door assembly 3, as is known in the art. The support bracket 13 according to the present invention is preferably devised to have receiving means 23 for receiving the first gear 15 and supporting means 25 for supporting the second gear 17.

Figure 4:
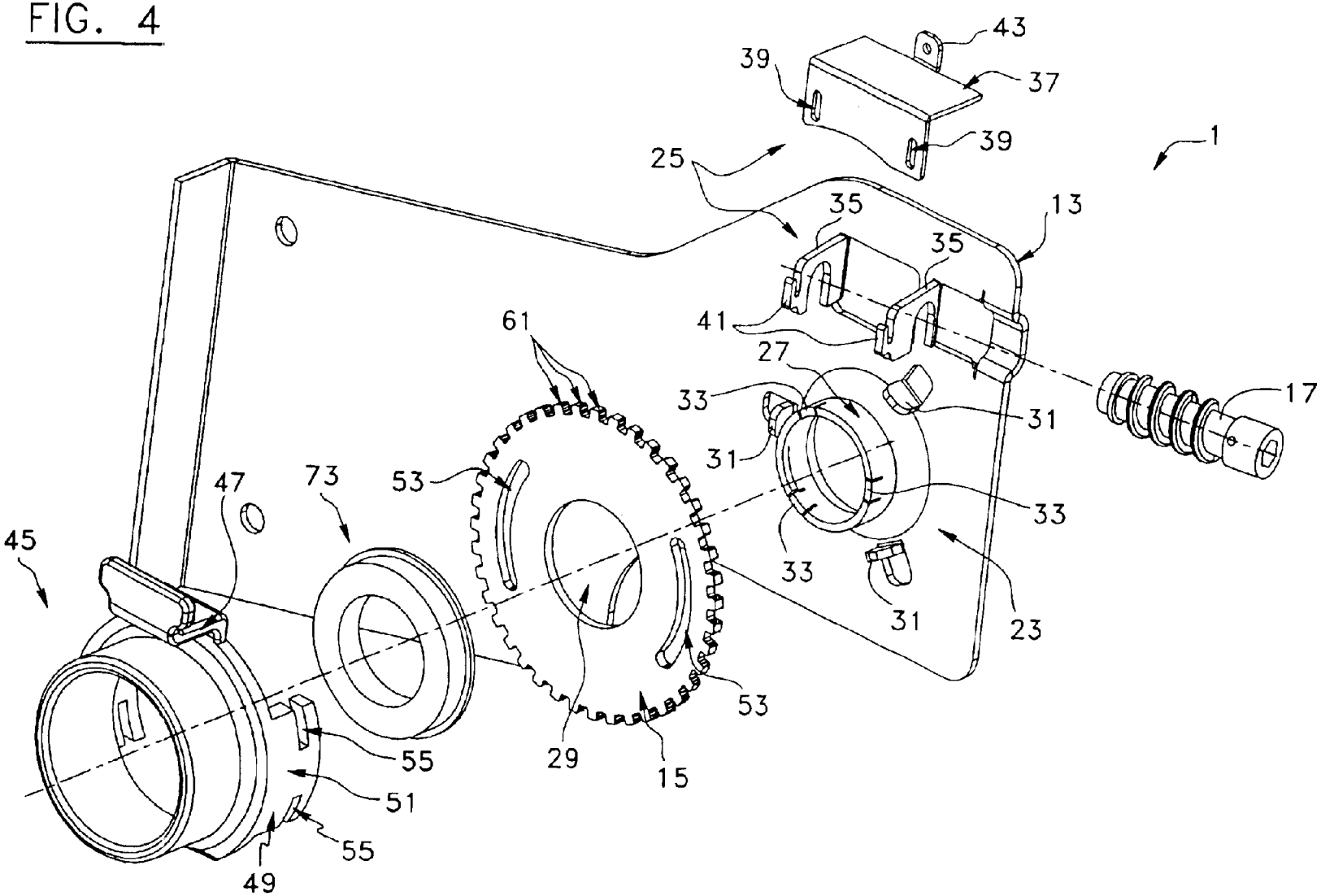
FIG. 4 is an exploded view of the winding system of FIG. 2.
Figure 5:
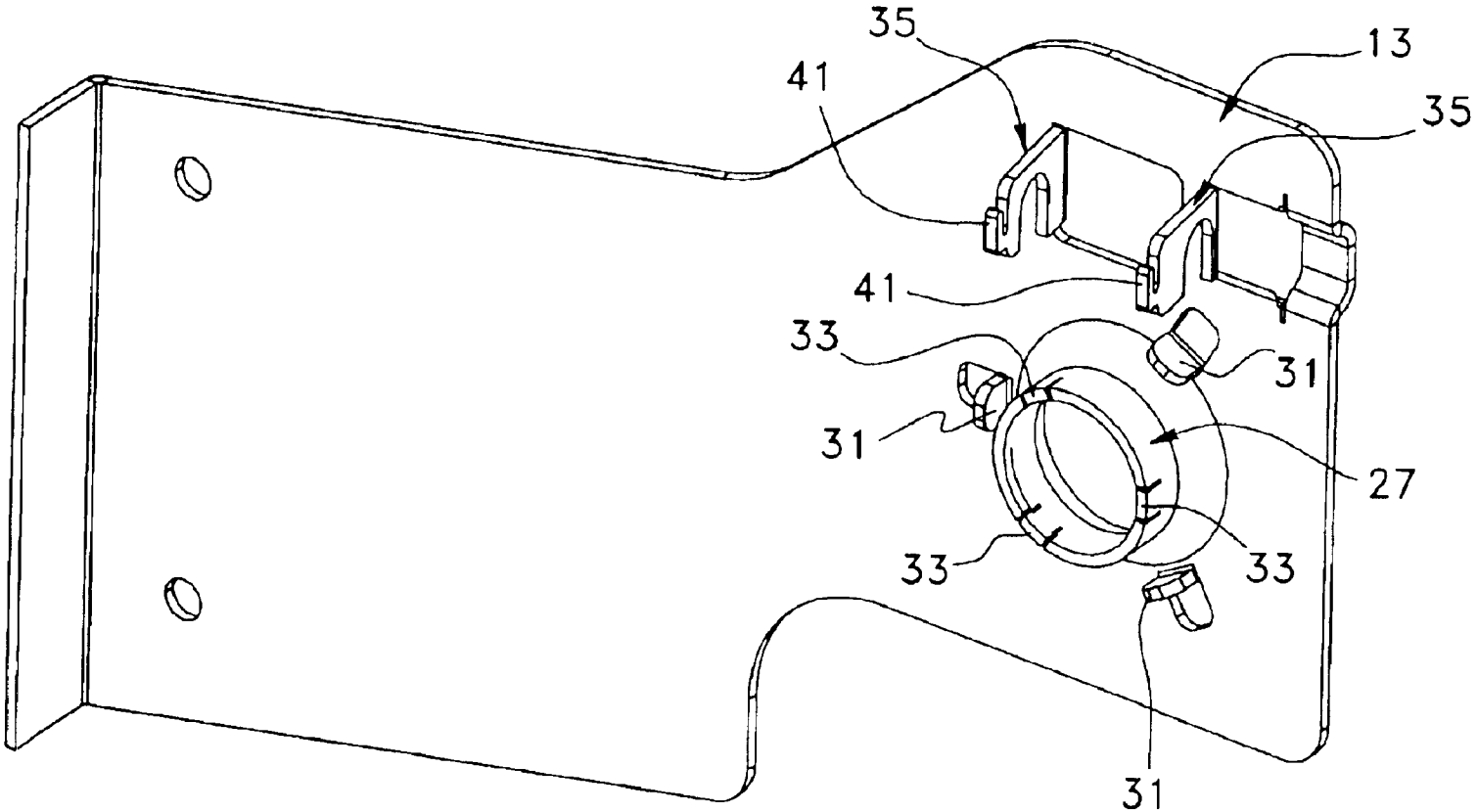
FIG. 5 is a perspective view of the support bracket of the winding system shown in FIG. 2.

Indeed, as can be easily understood when referring to FIG. 4, the first gear 15 is pivotally mounted about the receiving means 23 of the support bracket 13 and rotatable thereabout along opposite first and second directions of rotation. Similarly, the second gear 17 is pivotally mounted about the supporting means 25 of the support bracket 13, and is rotatable thereabout along opposite first and second directions of rotation. According to the present invention, and as aforementioned, the first gear 15 is operatively connected to the second end 19 of the counterbalancing spring 11 and the second gear 17 is threadably engaged with the first gear 15 such that, a rotation of the second gear 17 along one of its first and second directions of rotation causes the first gear 15 to rotate along a corresponding one of its first and second directions of rotation, thereby resulting in a corresponding winding of the counterbalancing spring 11 of the rolling door assembly 3.

As better shown in FIG. 4, the receiving means 23 preferably comprise a hub 27 projecting from the support plate. The hub 27 preferably has a cone-like shape and is preferably made integral to the support bracket 13, via a suitable process, such as extrusion for example, as apparent to a person skilled in the art. Preferably also, the first gear 15 is pivotally mounted about said hub 27, and a portion of the overhead shaft 5 extends through the first gear 15 and the hub 27, as better shown in FIG. 7. Consequently, the first gear 15 preferably has an orifice 29, as better shown in FIG. 4, through which extends the overhead shaft 5 and for mounting the first gear 15 onto the hub 27 of the support bracket 13. Preferably also, the winding system 1 comprises at least one spacer 31 projecting from the support bracket 13, each spacer 31 being positioned adjacent about the hub 27 for abutting with the first gear 15 and delimiting positioning of the same from the support bracket 13, that is, maintaining the first gear 15 at a given distance from the support bracket 13. The hub 27 also preferably comprises at least one longitudinal strip 33 being foldable against the first gear 15 for maintaining the same secured against the spacer(s) 31, as better shown in FIGS. 4–8. The combination of spacer(s) 31 and strip(s) 33 are namely devised also to properly position the first gear 15 with respect to the second gear 17 mounted about the supporting means 25 of the support bracket 13, as apparent to a person skilled in the art.

As better shown in FIG. 4, the supporting means 25 comprise at least one supporting arm 35, preferably a pair of supporting arms 35, projecting from the support bracket 13, and the second gear 17 is preferably pivotally mounted about the supporting arm(s) 35. The supporting arms 35 are preferably adapted to be at an angle with respect to the support bracket 13, as better shown in FIG. 3, in order to allow an optimal interaction between the gears 15,17, as apparent to a person skilled in the art. The angle between gears 15,17 is preferable selected to reduce friction on the system and allow a suitable force transmittal, as also apparent to a person skilled in the art.

The supporting means 25 also preferably comprise a cap 37 having a portion removably mountable onto the supporting arms 35 and another portion removably securable onto the support bracket 13. As better shown in FIG. 4, the cap 37 is preferably L-shaped, having a first portion provided with a pair of holes 39 for hooking onto corresponding hooks 41 of the pair of supporting arms 35 and a second portion provided with a fastening flange 43 for removably fastening or securing onto the support bracket 13, via suitable fasteners, such as screws, rivets, and the like, for example. It is worth mentioning that although in principle a single supporting arm 35, or other suitable supporting structure, may be used for supporting the second gear 17 and enabling it to move (e.g. rotate) with respect to the fixed structure 7, at least two supporting arms 35 and a corresponding cap 37 are preferably used for providing the supporting means 25 of the winding system 1 with greater structural rigidity and for assuring proper positioning of the second gear 17, among other advantages, as apparent to a person skilled in the art.

Figure 7:
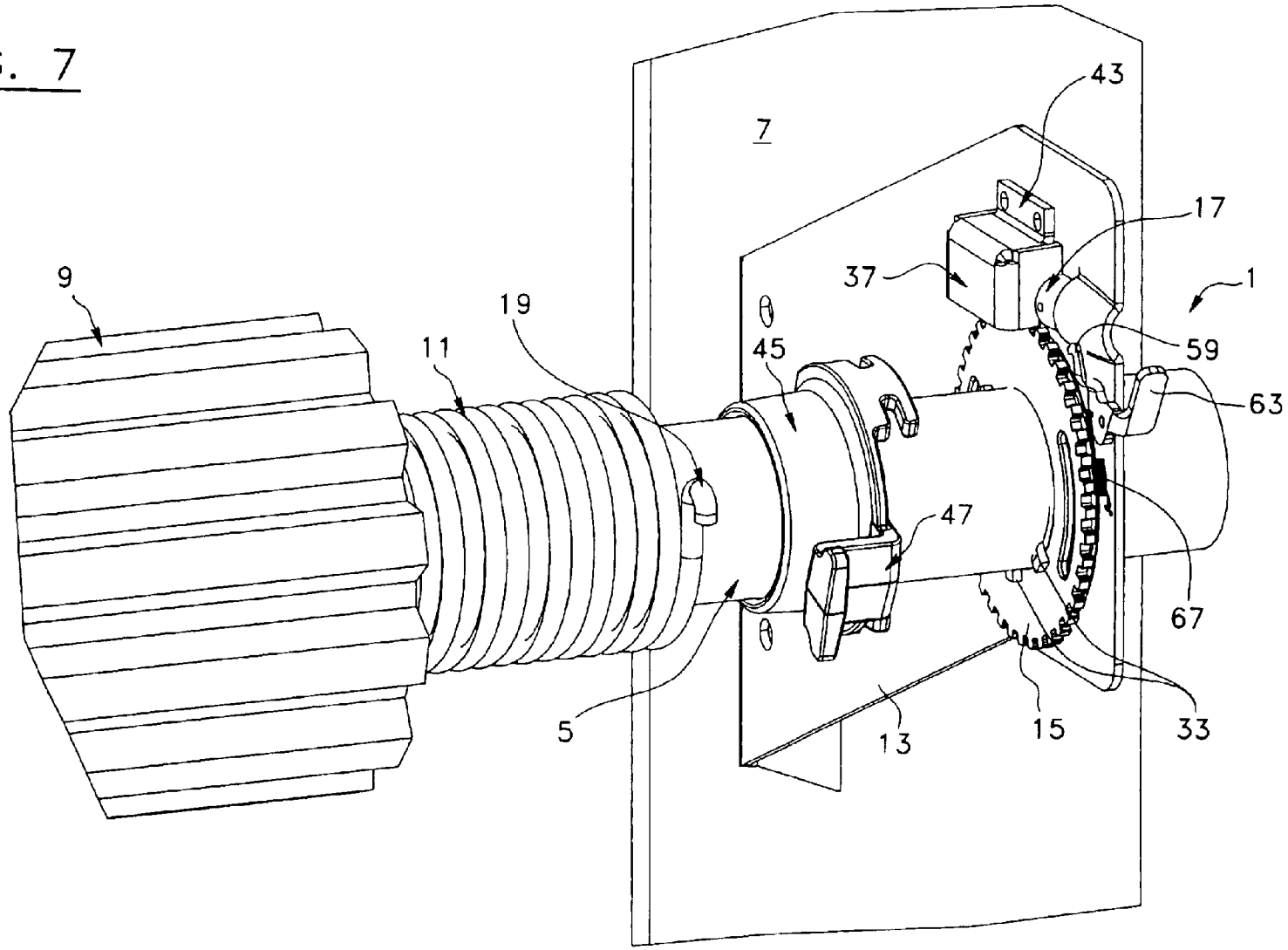
FIG. 7 is a perspective view of the winding system of FIG. 6, the winding system being now shown mounted onto a fixed structure, in an exploded manner with respect to a plug and a rolling door assembly, and with its safety device in the second position.

Preferably also, the winding system 1 comprises a plug 45 pivotally mounted about the overhead shaft 5, the plug 45 being used namely to operatively connect the second end 19 of the counterbalancing spring 11 to the first gear 15. The plug 45 preferably comprises a flange 47 operatively connected to the second end 19 of the counterbalancing spring 11 and connecting means 49 for removably connecting the plug 45 onto the first gear 15. The flange 47 of the plug 45 is preferably in abutment with the second end 19 of the counterbalancing spring 11, as shown in FIG. 1, or in abutment with a hooked portion of the second end 19 of the counterbalancing spring 11, as shown in FIG. 7. The connecting means 49 of the plug 45 preferably include at least one tongue 51 removably insertable into at least one corresponding slot 53 provided on the first gear 15. Each tongue 51 preferably comprise at least one slit 55 for engaging with the at least one corresponding slot 53 of the first gear 15. According to the embodiments shown in the accompanying drawings, the plug 45 preferably comprises a pair of tongues 51 removably insertable into a corresponding pair of slots 53 provided on the first gear 15, and each tongue 51 preferably comprise a pair of slits 55 for engaging with a corresponding slot 53 of the first gear 15.

As a protective measure, the winding system 1 preferably comprises a safety device 57 for maintaining the rolling door assembly 3 in a stable and fixed configuration, upon proper winding thereof, so as to not have to rely entirely on the worm gear assembly (e.g. first and second gears 15,17) of the winding system 1.

Indeed, as better shown in FIGS. 6–9, the winding system 1 may comprise a safety device 57 pivotally mounted about the support bracket 13 and positioned adjacent to the first gear 15, the safety device 57 having a pawl arm 59 removably insertable between a pair of adjacent teeth 61 of the first gear 15, said safety device 57 being operable between a first position where the pawl arm 59 is inserted into a pair of adjacent teeth 61 of the first gear 15 so as to prevent a rotation thereof, and a second position where the pawl arm 59 is away from the first gear 15 and allows the same to rotate.

Figure 8:
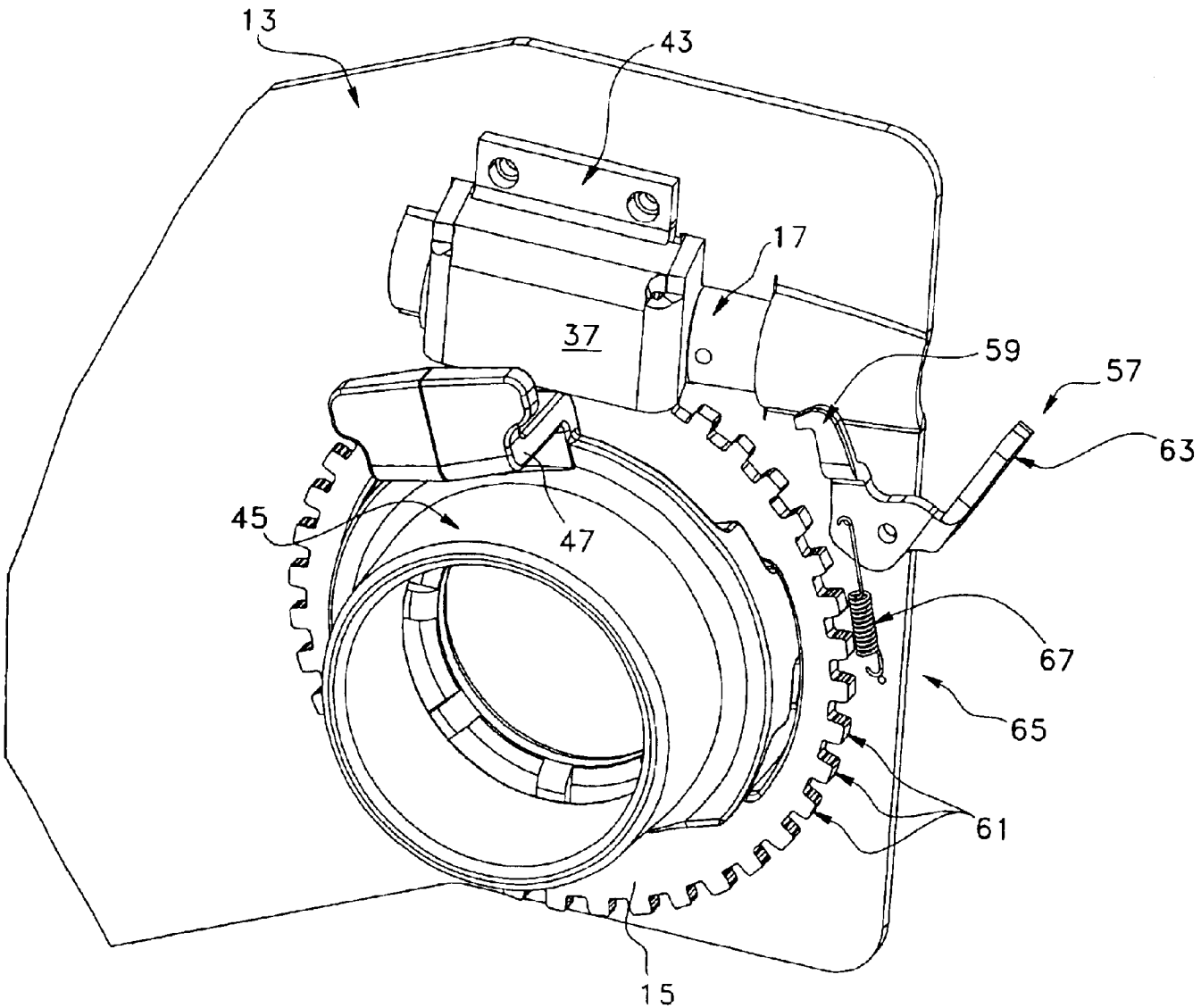
FIG. 8 is a partial perspective view of the winding system of FIG. 6, the winding system being shown now with a plug mounted onto the first gear and with its safety device in the second position.
Figure 9:
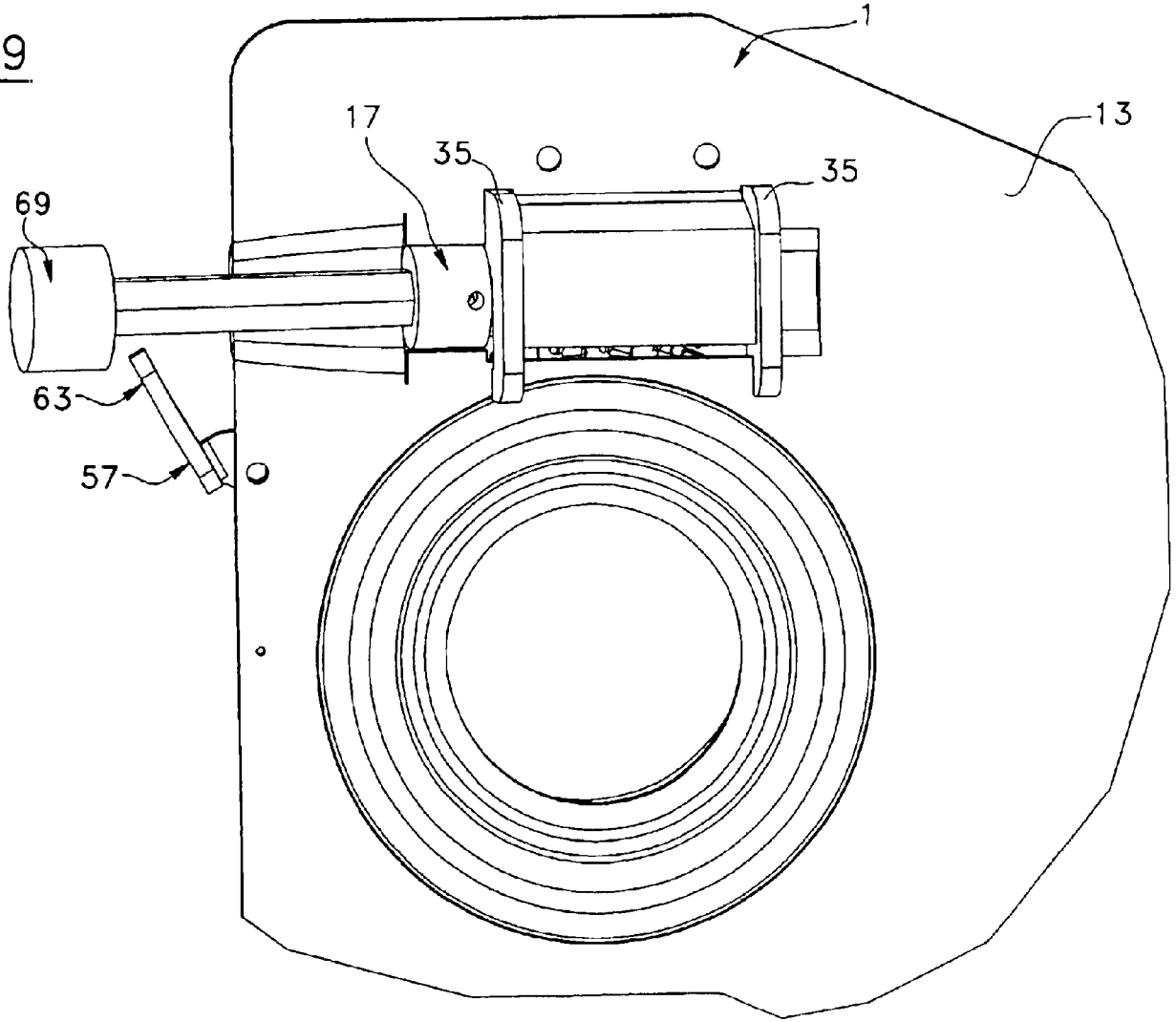
FIG. 9 is a rear partial perspective view of the winding system of FIG. 8, the winding system being shown now with the second gear operated by a tool.

Preferably, the safety device 57 further comprises a tab 63 extending from the pawl arm 59, said tab 63 being shaped and sized so as to cover access to the second gear 17 when the safety device 57 is in the first position, as better shown in FIG. 6, and so as to operate the safety device 57 in the second position when said tab 63 is drawn away from said access to the second gear 17, as shown in FIGS. 7–9.

Preferably also, the winding system 1 comprises biasing means 65 for biasing the safety device 57 into the first position, and the biasing means 65 preferably comprise a spring 67 operatively connected between the pawl arm 59 and the support bracket 13, as better shown in FIG. 8.

As can be easily understood when contrasting FIGS. 6 and 7–9, and as aforementioned, the safety device 57 is preferably operable between first and second positions ("locked" and "unlocked" positions respectively). The first position corresponds to the configuration where the hook-shaped pawl arm 59 of the safety device 57 is interlocked with the teeth 61 of the first gear 15, as better shown in FIG. 6, and the second position corresponds to the configuration where said hook-shaped pawl arm 59 is drawn away from the first gear 15 enabling the same to rotate about the receiving means 23 of the support bracket 13, as better shown in FIGS. 7–9. Preferably, the safety device 57 is actuated between the two above-mentioned positions by means of its flange-like tab 63. That is, in order to actuate the safety device 57 into the second position, one must simply pull on the tab 63 of the safety device 57, as can be understood when referring to FIGS. 6–9.

Referring now back to FIG. 6, one can understand that during normal operation of the winding system 1, the support bracket 13 thereof is preferably bolted onto a wall, and the shaft 5 of the garage door assembly 3 which supports the door 9, is preferably slid into the bracket 13 through the receiving means 23 thereof. A torsional spring 11 is also provided and preferably mounted onto the shaft 5 and operatively interconnected between the door assembly 3 and the fixed structure 7 though appropriate connecting means, such as a plug 45 for example, for counterbalancing the door weight when the door 9 is opened or closed. When the door 9, spring 11, plug 45, first and second gears 15,17 are operatively connected to one another, as apparent to a person skilled in the art in view of what is illustrated in the accompanying drawings, then the installer or the user of the present winding system 1 may wind and/or unwind the door assembly 3 by operating the worm assembly, and more particularly by operating the second gear 17. Typically, a suitable tool 69, such as an allen key for example, is inserted into a corresponding socket 71 of second gear 17, as better shown in FIGS. 4 and 9, in order to "screw" or "unscrew" (i.e. rotate, displace, etc.) the second gear 17 and thus drive the first gear 15 of the winding system 1, and consequently provide the torsional spring 11 of the winding system 1 with a desired tension. When this predetermined tension is attained, the worm assembly is preferably locked into position. As known in the art, the worm assembly, by virtue of its design, may be inadvertently tappered with, which could in turn result in an unwanted rotation of the gears 15,17 (e.g. free rotation thereof) and thus an undesirable raising or lowering of the garage door 9, or an inadequate counterbalancing of the assembly 3. To prevent these adverse consequences, a safety device 57 according to the present invention is provided on the support bracket 13 of the winding system 1, so that if one wants to access the worm assembly, the safety tab 63 must be pulled, this movement giving access to the worm assembly and to the socket 71 of the second gear 17, as better shown in FIGS. 7–9. Indeed, when in the first position, the safety device 57 not only blocks the first gear 15 by means of its hook-shaped pawl arm 59, but also provides a shield against the entry into the socket 71 of the second gear 17 by virtue of its tab 63, as better shown in FIG. 6. When in the second position, the first gear 15 is released by the pawl arm 59 and access to the socket 71 of the worm assembly (i.e. second gear 17) is provided because the flange-like safety tab 63 is removed therefrom, enabling to operate the worm assembly so as to wind and/or unwind the torsional spring 11.

As can be easily understood, although the safety device 57 of the winding system 1 is not an essential feature thereof, it nevertheless provides the same with substantial advantages, as discussed above.

It is to be understood that several modifications could be made to the present winding system 1 according to the present invention without departing from the scope of the present invention. Indeed, as aforementioned, the biasing means 65 are operatively connected between the support bracket 13 and the safety device 57 so as to exert a biasing force for urging the pawl arm 59 of the safety device 57 into the first gear 15. The biasing means 65 preferably comprise a loaded spring member 67, capable of storing potential energy via deformation so as to provide a potential force, the spring member 67 having a first end operatively connected to the support bracket 13 and a second end operatively connected to the safety device 57. It is worth mentioning however that other suitable biasing means 65 which do not use potential energy for providing a biasing force may be used according to the present invention, so long as these biasing means 65 are capable of biasing the pawl arm 59 of the safety device 57 in a suitable way towards the first gear 15 in the manner discussed above, as apparent to a person skilled in the art.

Moreover, it is worth mentioning that the biasing means 65 may have other suitable dispositions on the winding system 1 so as to ensure a corresponding biasing force on the pawl arm 59 of the safety device 57 towards the first gear 15. It is also worth mentioning that, according to the present invention, the spring member 67 is not absolutely necessary for proper operation of the winding system 1. Indeed, the biasing means 65 may simply consist of the effect of gravity acting on the safety device 57, in which case, the pawl arm 59 and tab 63 would be positioned, shaped, and sized onto the support bracket 13 so that, by virtue of the effect of gravity acting thereon, as apparent to a person skilled in the art, it would cause the safety device 57 to be in the first position, that is, to have namely the pawl arm 59 to be engaged with the first gear 15, said pawl arm 59 being releasable from the first gear 15 preferably by using the tab 63 as a lever arm, as described above.

It is worth mentioning also though that, according to the present invention, the safety device 57 may be disposed otherwise on support bracket 13 and/or on other parts of the winding system 1, as briefly described hereinabove and as apparent to a person skilled in the art.

The winding system 1 and corresponding parts (hub 27, plug 45, spacers 31, strips 33, supporting arms 35, cap 37, a flange 43, tongues 51, slits 55, safety device 57 and corresponding pawl arm 59, tab 63, spring 67, etc.) are preferably made of substantially rigid materials, such as metallic materials (steel, etc.), hardened polymers, composite materials, and/or the like, so as to ensure a proper operation thereof depending on the particular applications for which the winding system 1 is intended and the different parameters in cause (counterbalancing force in the spring 11, weight of the door 9, number of cycles, etc.), as apparent to a person skilled in the art.

It is to be understood that other modifications could be made to the present winding system 1 according to the present invention without departing from the scope of the present invention. Indeed, as aforementioned, the safety device 57 may be shaped, positioned, and sized in such a way that the effect of gravity will act to replace the biasing force of the spring member 67. Moreover, the end 19 of the counterbalancing spring 11 may be operatively connected directly onto the first gear 15 instead of using a plug 45. Moreover, instead of being mounted onto a hub 27, the first gear 15 could be mounted onto a corresponding orifice of the support bracket 13, as apparent to a person skilled in the art. Moreover, the winding system 1 may comprise a bearing 73 operatively positioned between the hub 27 (or orifice) of the support bracket 13 and the overhead shaft 5 and/or a bearing 73 operatively positioned between the plug 45 and the overhead shaft 5, as shown in FIG. 4, said bearing(s) 73 being used for facilitating relative displacement and reducing noise between neighboring parts. Furthermore, as aforementioned, the end 19 of the counterbalancing spring 11 may be operatively connected to the first gear 15, and thus, although advantageous for operation and assembling reasons namely, the plug 45 of the winding system 1, is not an essential component thereof. Moreover, the winding system 1 may be provided with a ratchet system cooperating with the overhead shaft 5 and/or the first gear 15 for preventing the same from being rotate along a given direction of rotation.

According to another aspect of the present invention, there is provided a rolling door assembly 3 provided with the above-mentioned winding system 1.

According to another aspect of the present invention, there is also provided a kit comprising some or several of the preferred components constituting the winding system 1 according to the present invention, as exemplified in FIGS. 4 and 7, so that a user may employ these components and assemble them so as to obtain a winding system 1 having the structural components and displaying the features described hereinabove.

As may now be better appreciated, the present invention is a substantial improvement and presents several advantages over devices and/or methods known on the prior art. Indeed, the present invention may be used in the garage door industry, with new door assemblies or existing door assemblies. In such cases, the present invention is devised to adjustably and precisely wind a rolling door assembly 3 without the use of a winding bar as in the case with conventional winding systems. The present invention is a compact, reliable, easy to use, easy to maintain, and cost effective system 1 for winding rolling door assemblies 3. Moreover, the present winding system 1 provides an easier way of winding rolling door assemblies 3 than what is possible with the devices and/or methods available in the prior art. Furthermore, the present invention may be used with other kinds of door assemblies 3, such as fire doors 9 and/or shutters for example, or with any other items provided with a shaft 5 requiring to be properly adjusted, rotation-wise, as aforementioned and as apparent to a person skilled in the art.

As may now be appreciated, the present invention is also a substantial improvement over the prior art in that by virtue of its safety device 57, it enables several advantages. Firstly, because the safety device 57 is biased against the first gear 15 in its first position (locked position), it enables to lock the gear in place in case of sliding between the worm gear assembly (i.e. first and second gears 15,17), thus provided with an added safety feature. Furthermore, by virtue of its design and components, namely its shielding tab 63, the safety device 57 enables to block the access to the worm assembly and assures that nobody may inadvertently wind and/or unwind the assembly 3 without previously disengaging the safety device 57 of the winding system 1.

Of course, numerous modifications could be made to the above-described embodiments without departing the scope of the invention, as defined in the appended claims.

What is claimed is:

1. A winding system for winding a rolling door assembly having an overhead shaft mounted about a fixed structure and rotatable thereabout along opposite first and second directions of rotation, a drum mounted about said overhead shaft, a door curtain foldable about the drum and unfoldable from the drum via a rotation of the drum, and a counterbalancing spring having first and second ends operatively connected to the overhead shaft and the fixed structure respectively for counterbalancing the rolling door assembly, the winding system comprising:

a support bracket rigidly connectable to the fixed structure, said support bracket having receiving means and supporting means, the receiving means comprising a hub projecting from the support plate;

a first gear pivotally mounted about the hub of the receiving means of the support bracket and rotatable thereabout along opposite first and second directions of rotation the first gear overhead shaft being extendable through said first gear and said hub;

a second gear pivotally mounted about the supporting means of the support bracket and rotatable thereabout along opposite first and second directions of rotation, said second gear being threadably engaged with the first gear such that, rotation of said second gear along one of its first and second directions of rotation causes the first gear to rotate along a corresponding one of its first and second directions of rotation, thereby resulting in a corresponding winding of the counterbalancing spring of the rolling door assembly; and at least one spacer projecting from the support bracket, said at least one spacer being positioned proximate the hub for abutting with the first gear and delimiting positioning of the first gear from the support bracket, the hub comprising at least one longitudinal strip being foldable against the first gear for maintaining the first gear secured against the at least one spacer.

2. A winding system according to claim 1, wherein the supporting means comprise at least one supporting arm projecting from the support bracket, and wherein the second gear is pivotally mounted about said at least one supporting arm.

3. A winding system according to claim 2, wherein the supporting means comprise a cap having a portion removably mountable onto the at least one supporting arm and another portion removably securable onto the support bracket.

4. A winding system according to claim 1, wherein the winding system comprises a plug pivotally mounted about the overhead shaft, said plug comprising a flange operatively connected to the second end of the counterbalancing spring and connecting means for removably connecting the plug onto the first gear.

5. A winding system according to claim 4, wherein the flange of the plug is in abutment with the second end of the counterbalancing spring and wherein the connection means of the plug include at least one tongue removably insertable into at least one corresponding slot provided on the first gear.

6. A winding system according to claim 5, wherein the at least one tongue comprise at least one slit for engaging with the at least one corresponding slot of the first gear.

7. A winding system according to claim 1, wherein the winding system comprises a safety device pivotally mounted about the support bracket and positioned adjacent to the first gear, the safety device having a pawl arm removably insertable between a pair of adjacent teeth of the first gear, said safety device being operable between a first position where the pawl arm is inserted into a pair of adjacent teeth of the first gear so as to prevent a rotation thereof, and a second position where the pawl arm is away from the first gear and allows the same to rotate.

8. A winding system according to claim 7, wherein the safety device further comprises a tab extending from the pawl arm, said tab being shaped and sized so as to cover access to the second gear when the safety device is in the first position, and so as to operate the safety device in the second position when said tab is drawn away from said access to the second gear.

9. A winding system according to claim 8, wherein the winding system comprises biasing means for biasing the safety device into the first position.

10. A winding system according to claim 9, wherein the biasing means comprise a spring operatively connected between the pawl arm and the support bracket.

11. A winding system according to claim 1, wherein the first and second gears are part of a worm gear assembly.

12. A winding system according to claim 1, wherein the support bracket includes a pair of supporting arms projecting from said support bracket, and wherein the winding system comprises:

a worm gear assembly mounted onto the support bracket, the worm gear assembly including the first gear being pivotally mounted about the hub of the support bracket, and the second gear being pivotally mounted about the pair of supporting arms;

spacers projecting from the support bracket, said spacers being positioned adjacent about the hub for abutting with the first gear and delimiting positioning of the same from the support bracket, the longitudinal strips of the hub being foldable against the first gear for maintaining the same secured against the spacers;

a cap having a portion removably mountable onto the pair of supporting arms and another portion removably securable onto the support bracket;

a plug pivotally mounted about the overhead shaft, said plug comprising a flange in abutment with the second end of the counterbalancing spring and a pair of tongues removably insertable into a pair of corresponding slots provided on the first gear for operatively connecting said plug to the first gear, each tongue comprising a pair of slits for engaging with a corresponding slot of the first gear; and a safety device pivotally mounted about the support bracket and positioned adjacent to the first gear, the safety device having a pawl arm removably insertable between a pair of adjacent teeth of the first gear, said safety device being operable between a first position where the pawl arm is inserted into a pair of adjacent teeth of the first gear so as to prevent rotation thereof, and a second position where the pawl arm is away from the first gear and allows the same to rotate, the safety device further including a tab extending from the pawl arm, said tab being shaped and sized so as to cover access to the second gear when the safety device is in the first position, and so as to operate the safety device in the second position when said tab is drawn away from said access to the second gear, the safety device being provided with a spring operatively connected between the pawl arm and the support bracket for biasing the safety device into the first position.

13. A rolling door assembly having an overhead shaft mounted about a fixed structure and rotatable thereabout along opposite first and second directions of rotation, a drum mounted about said overhead shaft, a door curtain foldable about the drum and unfoldable from the drum via a rotation of the drum, and a counterbalancing spring having first and second ends operatively connected to the overhead shaft and the fixed structure respectively for counterbalancing the rolling door assembly, the rolling door assembly being provided with a winding system comprising:

a support bracket rigidly connectable to the fixed structure, said support bracket having receiving means and supporting means, the receiving means comprising a hub projecting from the support plate;

a first gear pivotally mounted about the hub of the receiving means of the support bracket and rotatable thereabout along opposite first and second directions of rotation, the first gear being operatively connected to the second end of the counterbalancing spring, a portion of the overhead shaft being extendable through said first gear and said hub;

a second gear pivotally mounted about the supporting means of the support bracket and rotatable thereabout along opposite first and second directions of rotation, said second gear being threadably engaged with the first gear such that, rotation of said second gear along one of its first and second directions of rotation causes the first gear to rotate along a corresponding one of its first and second directions of rotation, thereby resulting in a corresponding winding of the counterbalancing spring of the rolling door assembly; and at least one spacer projecting from the support bracket said at least one spacer being positioned proximate the hub for abutting the first gear and delimiting positioning of the first gear from the support bracket, the hub comprising at least one longitudinal strip being foldable against the first gear for maintaining the first gear secured against the at least one spacer.

14. A kit for assembling a winding system for winding a rolling door assembly having an overhead shaft mounted about a fixed structure and rotatable thereabout along opposite first and second directions of rotation, a drum mounted about said overhead shaft, a door curtain foldable about the drum and unfoldable from the drum via a rotation of the drum, and a counterbalancing spring having first and second ends operatively connected to the overhead shaft and the fixed structure respectively for counterbalancing the rolling door assembly, the kit comprising:

a support bracket rigidly connectable to the fixed structure, said support bracket having receiving means and supporting means, the receiving means comprising a hub projecting from the support plate;

a first gear pivotally mountable about the hub of the receiving means of the support bracket and rotatable thereabout along opposite first and second directions of rotation, the first gear being operatively connectable to the second end of the counterbalancing spring, a portion of the overhead shaft being extendable through said first gear and said hub;

a second gear pivotally mountable about the supporting means of the support bracket and rotatable thereabout along opposite first and second directions of rotation, said second gear being operatively connected to the second end of the counterbalancing spring and being also threadably engaged with the first gear when the winding system is assembled such that, rotation of said first gear along one of its first and second directions of rotation causes the second gear to rotate along a corresponding one of its first and second directions of rotation, thereby resulting in a corresponding winding of the counterbalancing spring of the rolling door assembly; and at least one spacer projecting from the support bracket said at least one spacer being positioned proximate the hub for abutting the first gear and delimiting positioning of the first gear from the support bracket, the hub comprising at least one longitudinal strip being foldable against the first gear for maintaining the first gear secured against the at least one spacer.

15. A kit according to claim 14, wherein the kit comprises a plug pivotally mountable about the overhead shaft, said plug comprising a flange operatively connectable to the second end of the counterbalancing spring and connecting means for removably connecting the plug onto the first gear.

16. A kit according to claim 15, the kit comprises a safety device pivotally mountable about the support bracket and positionable adjacent to the first gear, the safety device having a pawl arm removably insertable between a pair of adjacent teeth of the first gear, said safety device being operable between a first position where the pawl arm is inserted into a pair of adjacent teeth of the first gear so as to prevent a rotation thereof, and a second position where the pawl arm is away from the first gear and allows the same to rotate, the safety device further including a tab extending from the pawl arm, said tab being shaped and sized so as to cover access to the first gear when the safety device is in the first position, and so as to operate the safety device in the second position when said tab is drawn away from said access to the first gear.

17. A kit according to claim 16, wherein the kit comprises a spring operatively connectable between the pawl arm and the support bracket for biasing the safety device into the first position.

* * * * *